US008418335B2

(12) United States Patent
Edwards

(10) Patent No.: US 8,418,335 B2
(45) Date of Patent: Apr. 16, 2013

(54) METHOD OF RETROFITTING STAIR RAILING SYSTEM WITH AN ADJUSTABLE BALUSTER

(75) Inventor: Matthew S. Edwards, Bolivar, OH (US)

(73) Assignee: Carolina Stair Supply, Inc., Uhrichsville, OH (US)

( * ) Notice: Subject to any disclaimer, the term of this patent is extended or adjusted under 35 U.S.C. 154(b) by 207 days.

(21) Appl. No.: 13/052,082

(22) Filed: Mar. 20, 2011

(65) Prior Publication Data

US 2011/0162183 A1 Jul. 7, 2011

Related U.S. Application Data

(60) Division of application No. 12/615,078, filed on Nov. 9, 2009, now Pat. No. 7,909,311, which is a continuation of application No. 11/656,599, filed on Jan. 23, 2007, now Pat. No. 7,614,612.

(51) Int. Cl.
*B21K 21/16* (2006.01)
*E04H 17/14* (2006.01)

(52) U.S. Cl.
USPC ..... 29/401.1; 256/67

(58) Field of Classification Search ..... 29/401.1, 29/402.01, 402.03, 402.08, 402.11, 402.14, 29/402.15, 402.17; 256/67, 59
See application file for complete search history.

(56) References Cited

U.S. PATENT DOCUMENTS 4,112,195 A * 9/1978 Pott et al. ..... 52/717.04
4,352,485 A * 10/1982 Basey ..... 256/65.01
4,403,767 A * 9/1983 Basey ..... 256/66

* cited by examiner

*Primary Examiner* — John C Hong
(74) *Attorney, Agent, or Firm* — Zollinger & Burleson Ltd.

(57) ABSTRACT

The present invention includes a baluster assembly system comprising: (a) a first baluster portion comprising a first tubular section and having a first attachment adapted to be attached to a surface, and a first engagement end; (b) a second baluster portion comprising a second tubular section and having a second attachment adapted to be attached to a surface, and a second engagement end; the first tubular section adapted to slidingly engage the second tubular section, and (c) a locking fixture adapted to fix the position of the first baluster portion with respect to the second baluster portion after the first tubular section and the second tubular section have been engaged.

12 Claims, 9 Drawing Sheets

13
15
14

13
14

78

81

80

7

11
8

74a
79
78
77a
76a 77
74
79
78
76

66a
4a
7
66

6a
4
7
6

METHOD OF RETROFITTING STAIR RAILING SYSTEM WITH AN ADJUSTABLE BALUSTER

CROSS REFERENCE TO RELATED APPLICATIONS

This application is a division of Ser. No. 12/615,078, filed Nov. 9, 2009, now U.S. Pat. No. 7,909,311, Mar. 22, 2011, which is a continuation of Ser. No. 11/656,599, filed Jan. 23, 2007, now U.S. Pat. No. 7,614,612, Nov. 10, 2009; the disclosures of which are incorporated herein by reference.

BACKGROUND OF THE INVENTION

1. Technical Field of the Invention

The invention relates to the field of stairs and railings, and methods of their construction and repair.

2. Background of the Invention

In the construction or repair of stairs and railings, it is desirable to be able to assemble a series of balusters as the railing is installed or, in the case of stair and railing repair, to be able to replace or reposition balusters conveniently and efficiently, without having to completely remove and reassemble the entire railing.

It is also desirable to be able to position and adjust balusters as a stair system is assembled to provide an accurate fit and support for the railing or stairs.

For instance, in the assembly of wood railings, it is most efficient if newels may be left in place while wood balusters are replaced with metal balusters.

Accordingly, there remains a need for improvement in systems for the construction and repair of stairs and railings, especially in the field of do-it-yourself home repair and improvement.

SUMMARY OF THE INVENTION

The present invention includes a baluster assembly system comprising: (a) a first baluster portion comprising a first tubular section and having a first attachment adapted to be attached to a surface, and a first engagement end; (b) a second baluster portion comprising a second tubular section and having a second attachment adapted to be attached to a surface, and a second engagement end; the first tubular section adapted to slidingly engage the second tubular section, and (c) a locking fixture adapted to fix the position of the first baluster portion with respect to the second baluster portion after the first tubular section and the second tubular section have been engaged. It is preferred that the first attachment is adapted to be attached to a first surface, and that the first attachment has a first attachment surface and is connected to the first baluster portion, directly or indirectly, so as to be able to change the orientation of the first attachment surface with respect to the first baluster portion. It is also preferred that the second attachment is adapted to be attached to a second surface, and that the second attachment likewise presents a second attachment surface and is connected to the second baluster portion, directly or indirectly, so as to be able to change the orientation of the second attachment surface with respect to the first tubular section.

At least one of the first baluster portion and second baluster portions may also include a non-tubular and/or non-linear portion disposed at a location unnecessary to the nesting of the opposed tubular portions, such as to provide architectural interest and variation, as exemplified by the embodiments shown in the drawings. These portions may include solid, twisted, curved, thinned or scrolled portions. The first baluster portion and/or the second baluster portion may also have an additional decorative portion attached to the thereto, such as upon the outer surface, as exemplified by the embodiments shown in the drawings.

For convenient assembly, it is preferred that the first and second baluster portions are of different lengths, such as is described and shown in more detail herein.

The locking fixture may comprise any means that are adapted to fix the position of the first baluster portion with respect to the second baluster portion, such as preferably a mechanical clamp, pin or set screw. The locking fixture may be adapted to fix the position of the first baluster portion with respect to the second baluster portion preferably comprises a screw portion threaded onto either of the first baluster portion and/or the second baluster portion.

It is preferred that, where one end of the first baluster portion is exposed when the first tubular section slidingly engages the second tubular section, and that the locking fixture is sized and adapted to fit over the exposed end of the first tubular section.

The present invention also includes a stair and railing system comprising: (a) a flight of stairs; (b) a railing disposed above the stairs such that the underside of the railing faces the stairs; and (c) a plurality of balusters extending between the railing and the flight of stairs, each baluster comprising: (i) a first baluster portion comprising a first tubular section having a first engagement end and having a first attachment adapted to be attached to the underside of the railing, the first attachment having an attachment surface and connected to the first tubular section so as to be able to change the orientation of the surface with respect to the first tubular section; (ii) a second baluster portion comprising a second tubular section and having a second attachment adapted to be attached to one of the stairs, and a second engagement end; the first tubular section adapted to slidingly engage the second tubular section, and (iii) a locking fixture adapted to fix the position of the first baluster portion with respect to the second baluster portion after the first tubular section and the second tubular section have been engaged.

The present invention also includes a method of installing a baluster in a stair and railing system, the method comprising (a) positioning the baluster between the flight of stairs and railing, (b) sliding the first tubular section and the second tubular section as described herein with respect to one another such that the first attachment may be attached to the underside of the railing, and the second attachment may be attached to one of the stairs, followed by (c) attaching the first attachment to the underside of the railing and attaching the second attachment may be attached to one of the stairs, and (d) fixing the position of the first baluster portion with respect to the second baluster portion.

The present invention also includes a method of replacing a baluster in a stair and railing system comprising a flight of stairs, a railing disposed above the stairs such that the underside of the railing faces the stairs; and a plurality of balusters, the method comprising the steps of: (a) removing one of the balusters so as to leave the stair and railing in place; (b) replacing the baluster with a replacement baluster in accordance with the present invention by (1) positioning the replacement baluster between the flight of stairs and railing, (2) sliding the first tubular section and the second tubular section as described herein with respect to one another such that the first attachment may be attached to the underside of the railing, and the second attachment may be attached to one of the stairs, followed by (3) attaching the first attachment to the underside of the railing and attaching the second attachment may be attached to one of the stairs, and (4) fixing the position of the first baluster portion with respect to the second baluster portion.

In replacing the balusters, each replacement baluster may be replaced one at a time by cutting the top and then the bottom of the existing wood baluster. The replacement baluster in accordance with the present invention is put in place of the removed baluster, and may be secured by wood screws, such as two screws used to secure the bottom base to the stair tread or capped rake wall. The replacement baluster is adjusted to the proper height, to fit the underside of the existing rail.

DETAILED DESCRIPTION OF THE PREFERRED EMBODIMENTS

In accordance with the foregoing summary, the following presents a detailed description of the preferred embodiments, which are presently considered to be the best mode.

Figure 1:
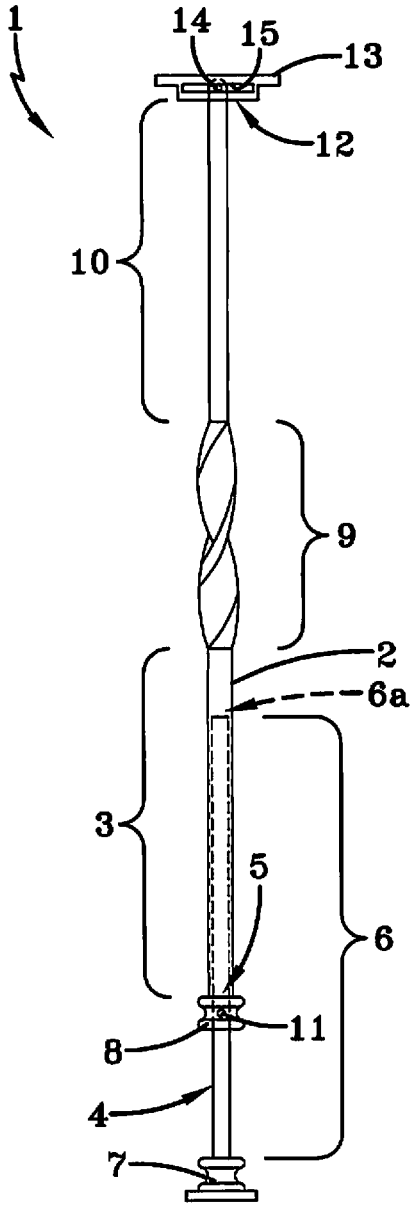
FIG. 1 shows an elevation view of a baluster in accordance with one embodiment of the present invention.

FIG. 1 shows an elevation view of a baluster 1 in accordance with one embodiment of the present invention. FIG. 1 shows a first baluster portion 2 comprising a first tubular section 3 and having a first attachment 12 adapted to be attached to a surface, and a first engagement end 5; (b) a second baluster portion 4 comprising a second tubular section 6 and having a second attachment 7 adapted to be attached to a surface, and a second engagement end 6*a*; the first tubular section adapted to slidingly engage the second tubular section, and (c) a locking fixture 8 adapted to fix the position of the first baluster portion 2 with respect to the second baluster portion 4 after the first tubular section and the second tubular section have been engaged.

At least one of the first baluster portion and second baluster portions may also include a non-tubular portion, such as 9 or 10, such as to provide architectural interest and variation. The first baluster portion and/or the second baluster portion may also have an additional decorative portion attached thereto, as exemplified by the embodiments shown in the drawings.

For convenient assembly, it is preferred that the first and second baluster portions 2 and 4 are of different lengths.

The locking fixture 8 may be adapted to fix the position of the first baluster portion with respect to the second baluster portion such as in the form of a set screw through aperture 11. The locking fixture may alternatively be in the form of a fixture that includes a screw thread to be threaded onto either of the first baluster portion and the second baluster portion, such as by having the exposed end of the first baluster portion 2 provided with a thread such that this portion of the first baluster portion is urged against the second baluster portion as the locking fixture is screwed onto the first baluster portion. The locking fixture may be made integral with the first baluster portion 2 or as a separate piece that may be made to slide into place.

It is preferred that, where one end 5 of the first baluster portion is exposed when the first tubular section 2 slidingly engages the second tubular section 4, that the locking fixture is sized and adapted to fit over the exposed end of the first tubular section 2.

First attachment 12 may be in the form of a cleat 13 that mounts to the first baluster portion 2 by a swivel pin 14 that may also slide within channel 15 to allow the cleat to be best positioned to fit against a surface, such as the underside of a stair railing or other structure (not shown).

Figure 2:
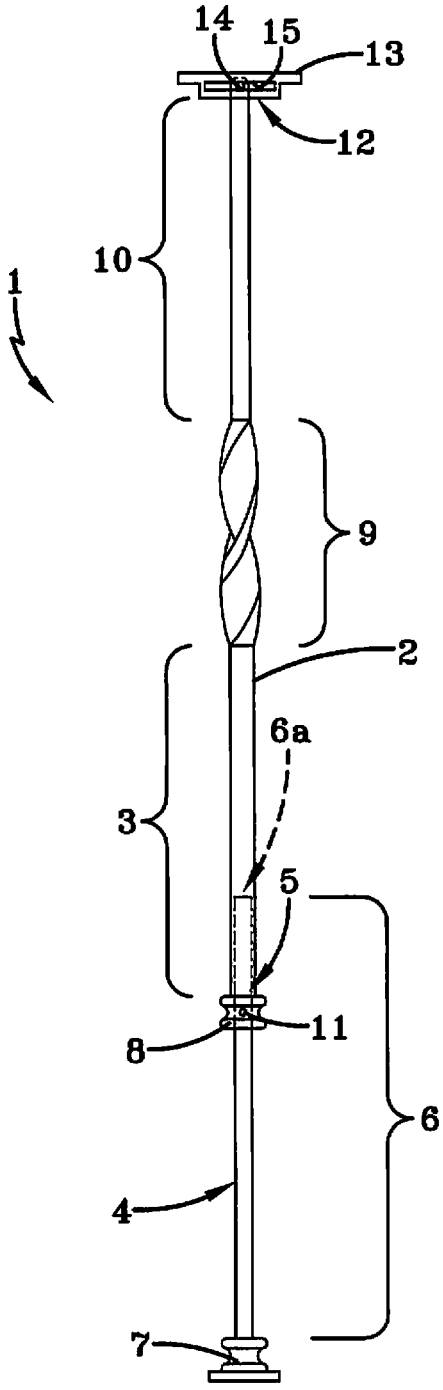
FIG. 2 shows an elevation view of another configuration of the baluster shown in FIG. 1.

FIG. 2 shows an elevation view of another configuration of the baluster shown in FIG. 1, with reference like numerals referring to the same portions thereof. This view shows the second baluster portion 4 extended to a different length configuration.

Figure 3:
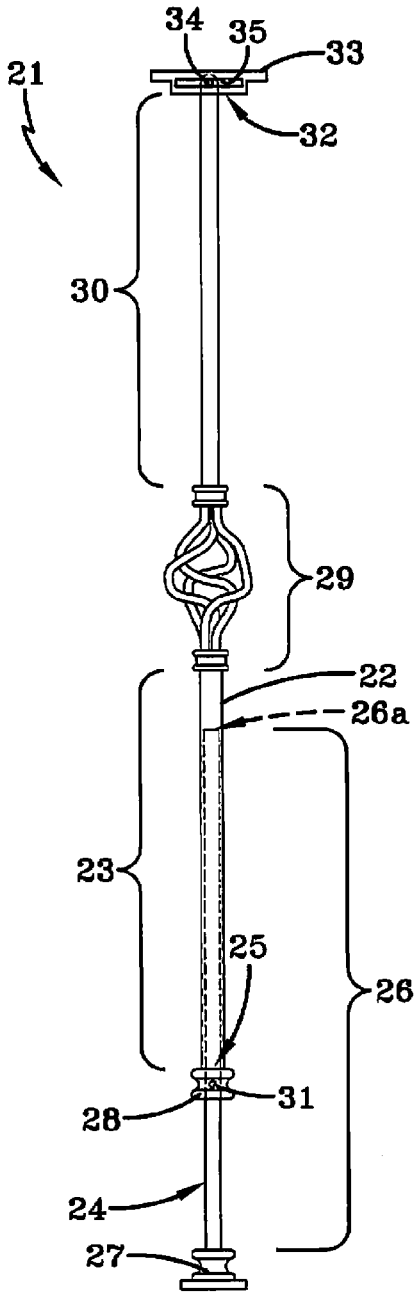
FIG. 3 shows an elevation view of a baluster in accordance with still another embodiment of the present invention.

FIG. 3 shows an elevation view of a baluster in accordance with still another embodiment of the present invention.

FIG. 3 shows an elevation view of a baluster 1 in accordance with one embodiment of the present invention. FIG. 3 shows a first baluster portion 22 comprising a first tubular section 23 and having a first attachment 32 adapted to be attached to a surface, and a first engagement end 25; (b) a second baluster portion 24 comprising a second tubular section 26 and having a second attachment 27 adapted to be attached to a surface, and a second engagement end 26*a*; the first tubular section adapted to slidingly engage the second tubular section, and (c) a locking fixture 28 adapted to fix the position of the first baluster portion 22 with respect to the second baluster portion 24 after the first tubular section and the second tubular section have been engaged.

At least one of the first baluster portion and second baluster portions may also include a non-tubular portion, such as 29 or 30 (portion 30 optionally may also be tubular), such as to provide architectural interest and variation.

Figure 4:
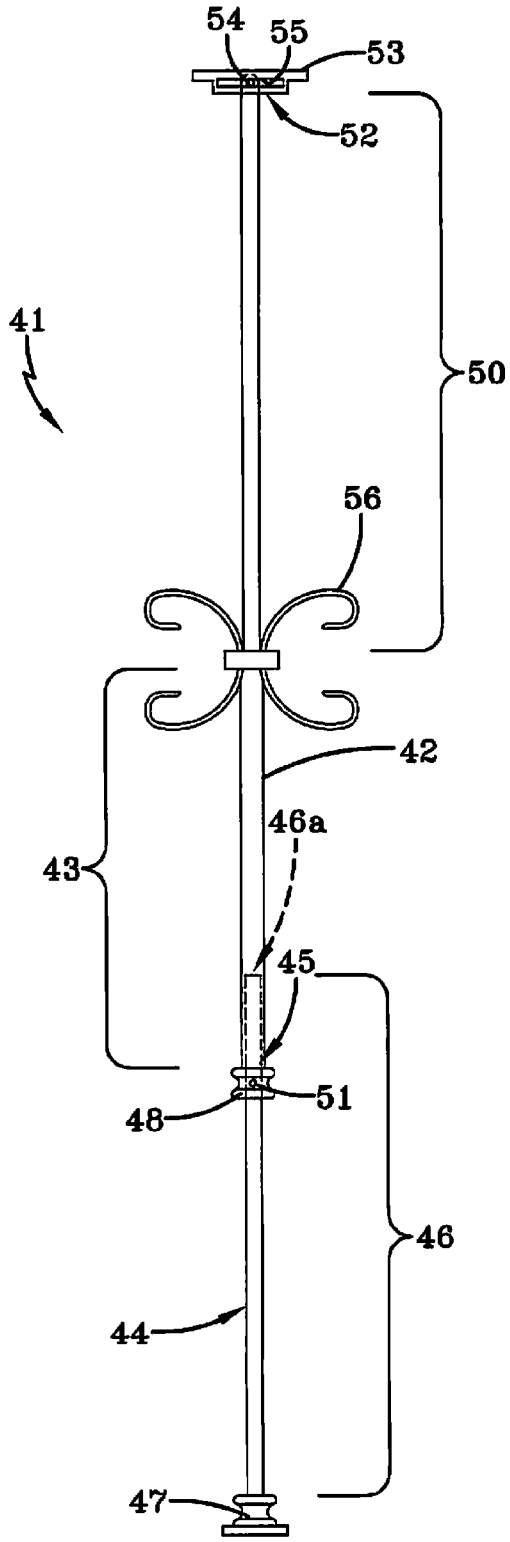
FIG. 4 shows an elevation view of a baluster in accordance with yet another embodiment of the present invention.

FIG. 4 shows an elevation view of a baluster in accordance with still another embodiment of the present invention.

FIG. 4 shows an elevation view of a baluster 41 in accordance with one embodiment of the present invention. FIG. 3 shows a first baluster portion 42 comprising a first tubular section 43 and having a first attachment 52 adapted to be attached to a surface, and a first engagement end 45; (b) a second baluster portion 24 comprising a second tubular section 46 and having a second attachment 47 adapted to be attached to a surface, and a second engagement end 46*a*; the first tubular section adapted to slidingly engage the second tubular section, and (c) a locking fixture 48 adapted to fix the position of the first baluster portion 42 with respect to the second baluster portion 44 after the first tubular section and the second tubular section have been engaged.

The first baluster portion and/or the second baluster portion may also have an additional decorative portion 56 attached thereto to provide additional aesthetic or architectural interest.

Figures 5, 6, 7, 8, 9, 10, 11, 12, 13, 14, 15:
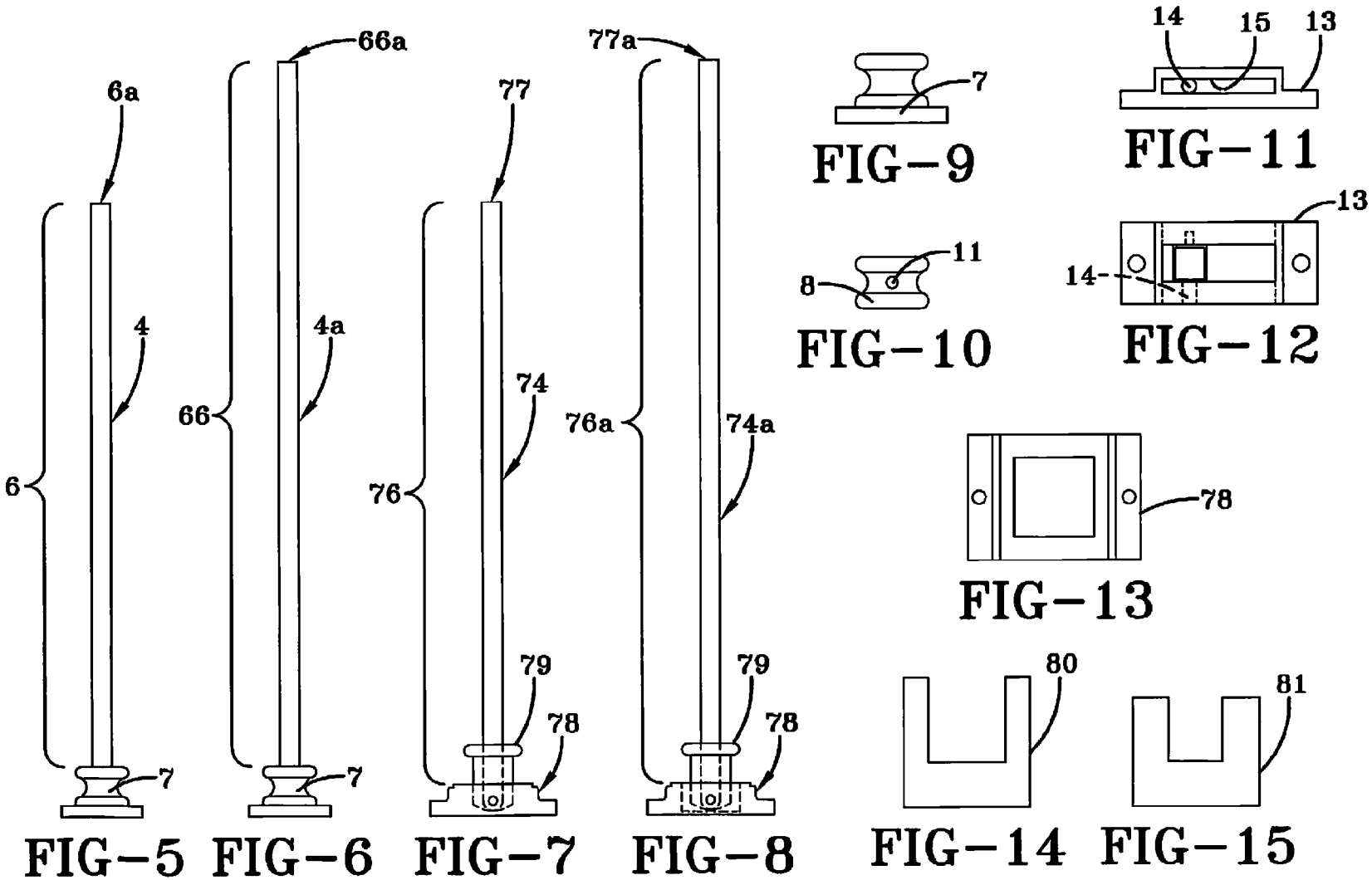
FIG. 5 shows an elevation view of a portion of a baluster in accordance with one embodiment of the present invention.
FIG. 6 shows an elevation view of a portion of a baluster in accordance with one embodiment of the present invention.
FIG. 7 shows an elevation view of a portion of a baluster in accordance with one embodiment of the present invention.
FIG. 8 shows an elevation view of a portion of a baluster in accordance with one embodiment of the present invention.
FIG. 9 shows a detailed elevation view of an attachment portion 7 of a baluster in accordance with one embodiment of the present invention shown in FIG. 1.
FIG. 10 shows a detailed elevation view of a locking fixture in accordance with the embodiment of FIG. 1.
FIG. 11 shows a detailed elevation view of an attachment piece in accordance with the embodiment of FIG. 1.
FIG. 12 shows a detailed plan view of an attachment piece in accordance with the embodiment of FIG. 1.
FIG. 13 shows a detailed plan view of an attachment piece in accordance with the embodiment of FIGS. 7 and 8.
FIGS. 14 and 15 show optional protective pieces that may be used in a baluster replacement kit.

FIG. 5 shows an elevation view of a portion of a baluster in accordance with one embodiment of the present invention. FIG. 5 shows the second baluster portion as used in the baluster of FIG. 1, and wherein like reference numerals are used.

FIG. 6 shows an elevation view of a portion of a baluster in accordance with one embodiment of the present invention. FIG. 6 shows the second baluster portion as used in the baluster of FIG. 1, and wherein like reference numerals are used, but wherein the second baluster portion 4 is replaced with a longer portion 4*a* having second tubular portion 66 and a second engagement end 66*a*.

FIG. 7 shows an elevation view of a portion of a baluster in accordance with one embodiment of the present invention. This Figure shows an alternative second baluster portion 74 having second tubular portion 76 and a second engagement end 77, that may be used in accordance with the present invention. This second baluster portion 74 may be provided with an attachment portion in the form of a swivel base 78.

FIG. 8 shows an elevation view of a portion of a baluster in accordance with one embodiment of the present invention. FIG. 8 shows the second baluster portion as used in the baluster of FIG. 7, and wherein like reference numerals are used, but wherein the second baluster portion 74 is replaced with a longer portion 74*a* having second tubular portion 76*a* and a second engagement end 77*a*.

As seen in FIGS. 7 and 8, the swivel base includes an additional finish structure 79 that is shaped on its bottom so as to fit within a recess in the cleat to be able to rotate with the second baluster portion 74/74*a* while protecting and concealing the balance of the swivel mechanism. The top portion of the finish structure 79 preferably has an aperture that fits around the second baluster portion to allow it to swivel within the base while providing a finished appearance.

FIG. 9 shows a detailed elevation view of an attachment portion 7 of a baluster in accordance with one embodiment of the present invention shown in FIG. 1.

FIG. 10 shows a detailed elevation view of a locking fixture 8 having aperture 11 for a baluster in accordance with one embodiment of the present invention shown in FIG. 1.

FIG. 11 shows a detailed elevation view of an attachment piece 12 in accordance with the embodiment of FIG. 1, and wherein the same reference numerals are used.

FIG. 12 shows a detailed plan view of an attachment piece 12 in accordance with the embodiment of FIG. 1, and wherein the same reference numerals are used.

FIG. 13 shows a detailed plan view of an attachment portion 78 in accordance with the embodiment of FIGS. 7 and 8.

Figure 16:
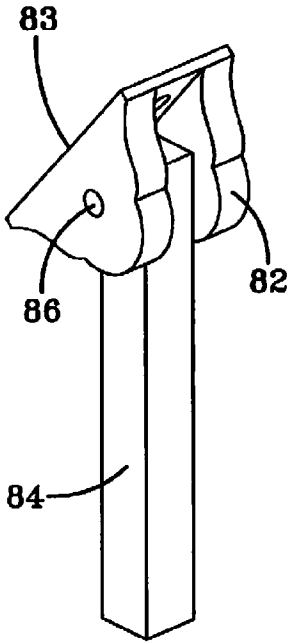
FIG. 16 shows an optional attachment piece attached to a portion of a baluster as a variation to that shown in FIGS. 1-4 and 11 and 12, in accordance with another embodiment of the present invention.

FIG. 16 shows an optional attachment piece attached to a portion of a baluster as a variation to that shown in FIGS. 1-4 and 11 and 12, in accordance with another embodiment of the present invention. FIG. 16 shows upper attachment bracket 82 that attaches to the underside of a stair railing such as by placing screws through holes drilled therein, and such that engagement surface 83 engages the underside of a stair railing (see FIG. 21). The attachment bracket 82 is attached to upper baluster portion 84 (equivalent to items 10, 30 and 50 in FIGS. 1-4), such that the angle of engagement surface 83 may be changed with respect to upper baluster portion 84. This may be done for instance by a fastener such as screw 86 that may be tightened once the appropriate angle is arrived at by placing the attachment bracket 82 along the underside of a stair railing with the upper baluster portion 84 in the proper vertical orientation (see FIG. 21) in a complete baluster assembly (as shown for instance in FIGS. 1-4). Accordingly, the upper attachment bracket 82 may adjust to any angle and may be installed with one or more fasteners or even adhesive. This eliminates the need for more complicated drilling, and fitting of the cast trim to cover the drilled connection. This also eliminates the need to grind the engagement surface to fit the angle presented by the stair rail. In addition, the ability to quickly assemble and reassemble the baluster, allows the baluster itself, the railing or other portions of the stair assembly to be repaired, replaced or refinished. Using the optional decorative pieces, the aesthetic appearance or style of the baluster assembly may also be changed relatively quickly without moving to replace other portions stair assembly which would be permanently damaged in the case of permanently affixed balusters.

Figure 17:
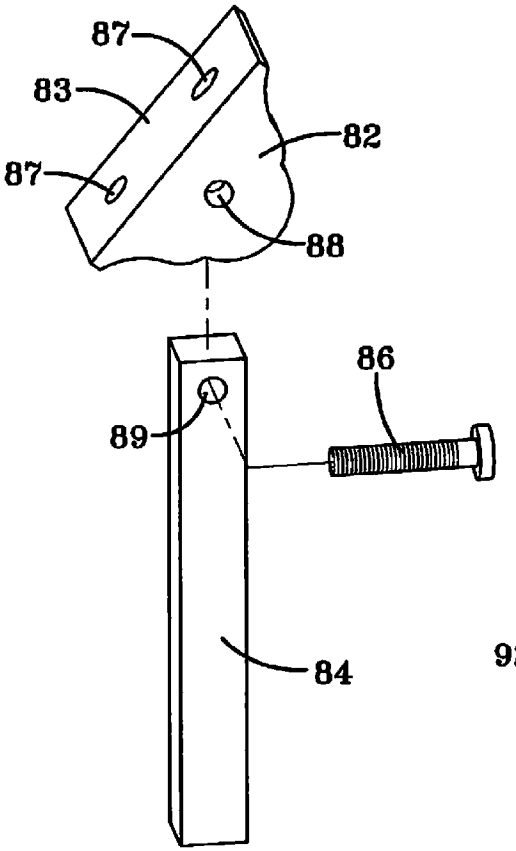
FIG. 17 shows an exploded view of the optional attachment piece attached to a portion of a baluster, shown in FIG. 16.

FIG. 17 shows an exploded view of the optional attachment piece attached to a portion of a baluster, shown in FIG. 16. FIG. 17 shows attachment bracket 82 with screw holes 87 drilled in and through attachment bracket 82 and engagement surface 83. FIG. 17 also shows screw 86 that extends through aperture 88 in attachment bracket 82 and aperture 88 in upper baluster portion 84 when the two pieces are assembles as shown in FIG. 16.

Figure 18:
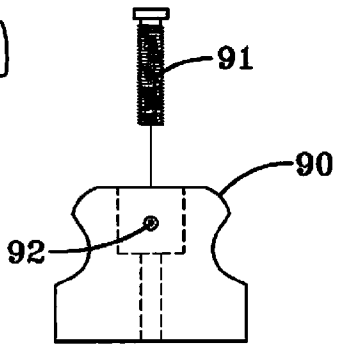
FIG. 18 shows an optional attachment portion as a variation to that shown in FIGS. 1-6, and 9, in accordance with another embodiment of the present invention.
Figure 21:
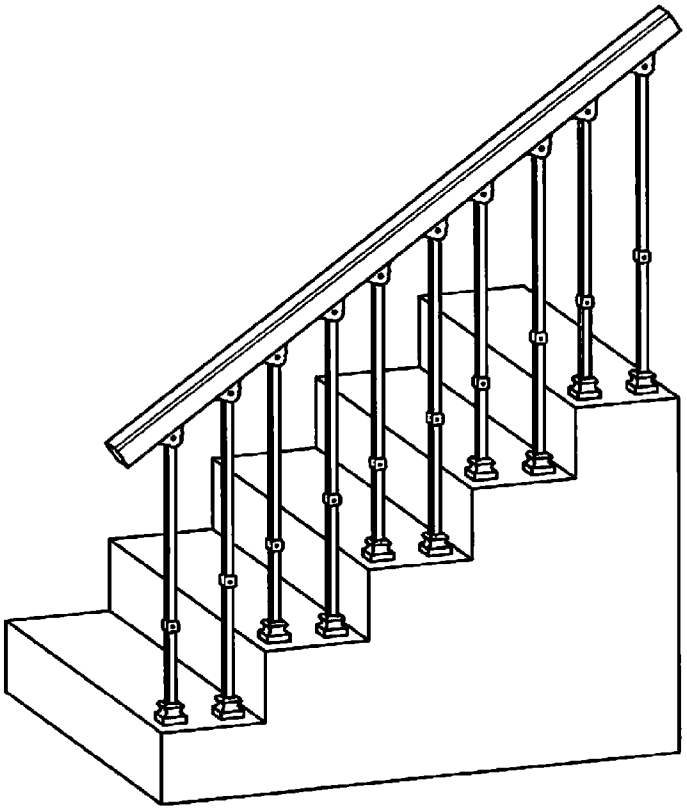
FIG. 21 shows an elevation view of a stair case having a set of balusters provided in accordance with the method and devices of one embodiment of the present invention.

FIG. 18 shows an optional bottom attachment portion 90 attached to a portion of a baluster as a variation to that shown in FIGS. 1-6 and 9, in accordance with another embodiment of the present invention. FIG. 18 shows fastener screw 91 that extends though the bottom of bottom attachment portion 90 to be fixed onto a stair step as shown in FIG. 21. FIG. 18 also shows set screw 92 that fixes lower baluster portion 93 as shown in FIG. 19.

Figure 19:
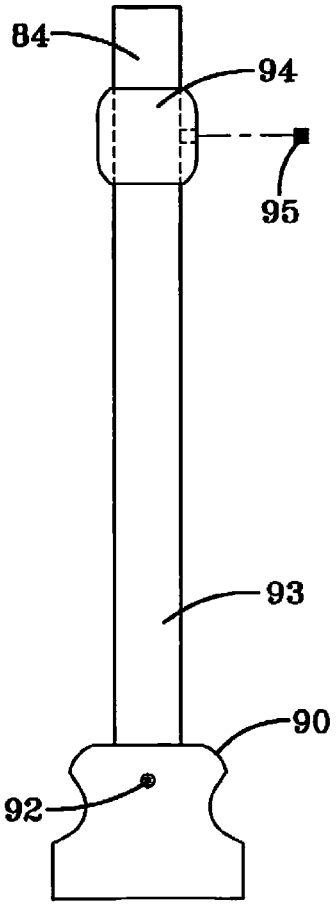
FIG. 19 shows an optional attachment portion attached to a portion of a baluster as a variation to that shown in FIGS. 1-6 and 9, in accordance with another embodiment of the present invention.

FIG. 19 shows an optional attachment portion 90 attached to a lower baluster portion 93 as a variation to that shown in FIGS. 1-6 and 9, in accordance with another embodiment of the present invention. Fixture portion 94 contains a threaded aperture to accepted set screw 95 (or other equivalent mechanical arrangement) to allow upper baluster portion 84 to be fixed with respect to lower baluster portion 93. As an alternative, the baluster portion having the larger inside diameter of the two (such as the upper portion shown in the Figures) may simply be tapered at the end to more closely approximate a continuous line formed by the engaged baluster portions. In this embodiment, a set screw may be placed directly into the baluster portion having the larger inside diameter.

The optional bottom attachment portion 90 is easy to install by identifying the tread layout and placing a lead hole.

The entire baluster may be installed in minutes, normally by using a drill, screw drive and/or Allen wrench. Typically, the bottom attachment portion is placed and affixed on the stair, and the lower baluster portion (in sliding engagement with the upper baluster portion) is affixed to the bottom attachment portion. The upper baluster portion (with upper attachment bracket attached to be able to swivel) is raised until the upper attachment bracket engages the underside of the stair railing to bring it into proper alignment with the angle of the stair railing. The upper attachment bracket is then attached to the underside of the stair railing and the lower baluster portion and upper baluster portion are then fixed in position.

In a preferred embodiment, the invention may use a bottom attachment bracket and an upper attachment bracket that are both adapted to swivel with respect to the portions of the baluster to which they are attached, as shown in FIGS. 7 and 8 and FIGS. 16 and 17. Such an arrangement allows for the bottom attachment bracket to be fixed and the baluster portion attached while the portion of the baluster to which it is then attached and swiveled into the final vertical position. The swivel upper attachment bracket may then be used to allow the engagement surface to align with the railing surface to which it is then affixed.

Optionally, the baluster may also include one or more decorative pieces such as may be appreciated from FIG. 21, which are attached at a desired height on the upper (or lower) baluster portion. These decorative pieces may be affixed using a sleeve adapted to slide along the length of the upper (or lower) baluster portion and to be fixed in place by a set screw similar to set screw 95.

Examples of decorative pieces are shown in FIGS. 22-26 as items 96-100 respectively. Each of these has one or more sleeve portions, such as portions 101-105 (sleeve on the opposite side of decorative piece 99, and thus not shown) which are sized to allow the baluster portion(s) slide into it/them and be fixed in place, such as with a set screw or other appropriate fixture or fixative. The decorative piece(s) is/are typically placed onto the upper or lower baluster portion while in sliding engagement with one another, and typically are finally located and fixed once the upper and lower baluster portions are fixed in place with respect to one another. Decorative pieces that may be used in accordance with the present invention may be obtained commercially, such as from King Architectural Metals of Baltimore, Md.

In using the present invention in a method of installing a baluster in a stair and railing system comprising a flight of stairs, a railing disposed above the stairs such that the underside of the railing faces the stairs, the method may be carried out by positioning the baluster between the flight of stairs and railing, and sliding the first tubular section and the second tubular section with respect to one another such that the first attachment may be attached to the underside of the railing, and the second attachment may be attached to one of the stairs, followed by attaching the first attachment to the underside of the railing and attaching the second attachment may be attached to one of the stairs, and fixing the position of the first baluster portion with respect to the second baluster portion. In a preferred embodiment of the present invention, the second attachment attached to one of the stairs is adapted to allow the lower baluster portion to swivel into place after the second attachment is fixed to the stair.

This method may be used in replacing existing balusters by first removing one of the balusters so as to leave the stair and railing in place; followed by replacing the baluster with a replacement baluster of the present invention by positioning the replacement baluster between the flight of stairs and railing, sliding the first tubular section and the second tubular section with respect to one another such that the first attachment may be attached to the underside of the railing, and the second attachment may be attached to one of the stairs, followed by attaching the first attachment to the underside of the railing and attaching the second attachment may be attached to one of the stairs, and fixing the position of the first baluster portion with respect to the second baluster portion. In removing the existing balusters, one may use optional protective pieces 80 and 81, such as those shown in FIGS. 14 and 15, of different sizes that may be positioned about the top and/or bottom end of the existing wood balusters to protect the stair and rail surfaces while the wooden baluster is removed, such as by sawing. These protective pieces may be made of appropriate grade of steel, such as 28 gauge steel. These pieces may be provided in a baluster replacement kit.

Figure 20:
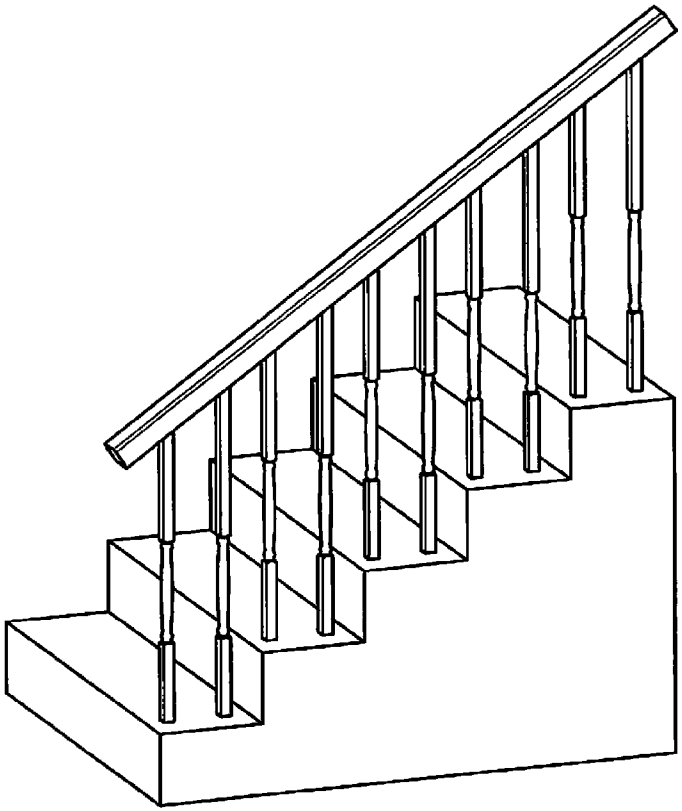
FIG-20 PRIOR ART
FIG. 20 shows an elevation view of a stair case with traditional railing to which the method and devices of the present invention may be applied in accordance with one embodiment thereof.
Figure 22:
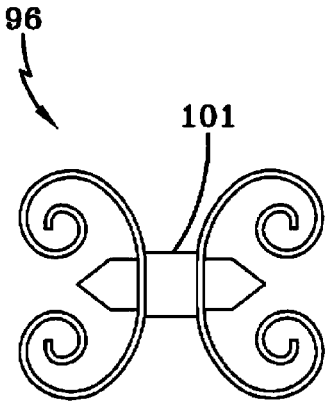
FIGS. 22-26 show elevation views of decorative pieces that may be used in accordance with several embodiments of the present invention.
Figure 23:
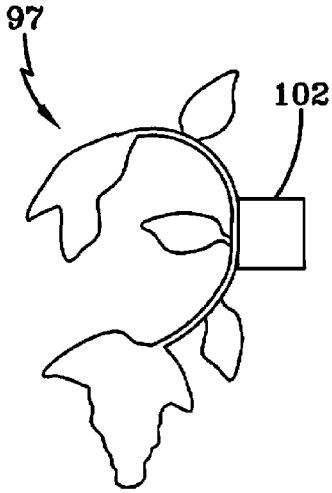
Figure 24:
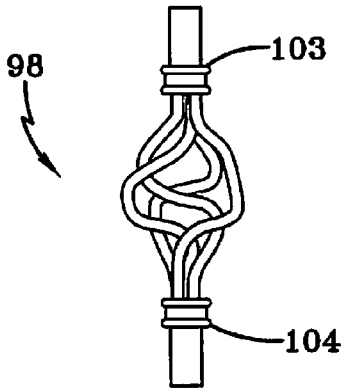
Figure 25:
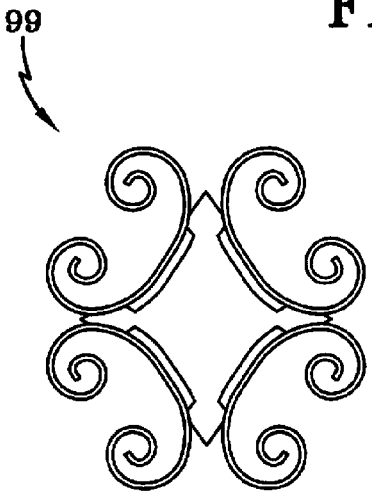
Figure 26:
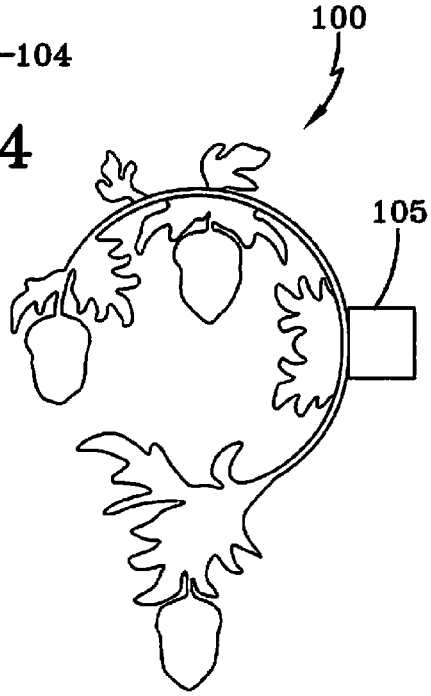

FIG. 20 shows an elevation view of a stair case with traditional railing to which the method and devices of the present invention may be applied in accordance with one embodiment thereof. In accordance with one embodiment of the present invention, a stair case with traditional railing may be retrofit with a series of balusters in accordance with the present invention.

FIG. 21 shows an elevation view of a stair case having a set of balusters such as that shown in FIGS. 16-19 and provided in accordance with the method of one embodiment of the present invention after the original balusters have been replaced.

Figure 27:
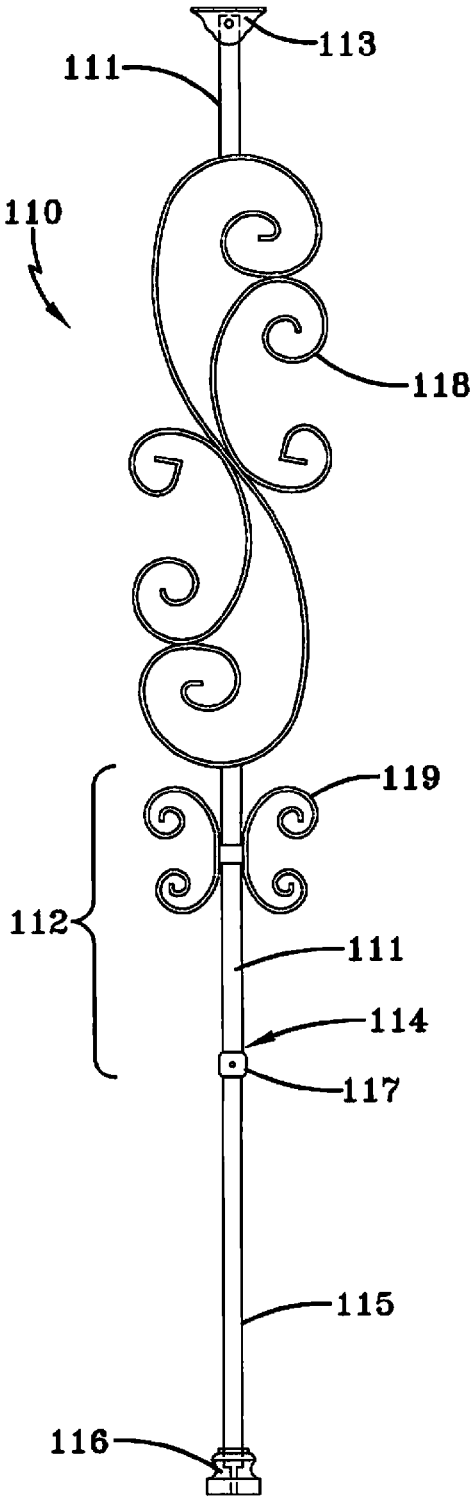
FIG. 27 shows an elevation view of a baluster in accordance with another embodiment of the present invention.

FIG. 27 shows an elevation view of a baluster 110 in accordance with one embodiment of the present invention. FIG. 27 shows a first baluster portion 111 comprising a first tubular section 112 and having a first attachment 113 adapted to be attached to a surface, and a first engagement end 114; (b) a second baluster portion 115 that in this embodiment is adapted to extend into first tubular section 112, and having a second attachment 116 adapted to be attached to a surface, and a second engagement end (not shown); the first tubular section adapted to slidingly engage the second baluster portion 115, and (c) a locking fixture 117 adapted to fix the position of the first tubular section 112 with respect to the second baluster portion 115 after they have been engaged.

At least one of the first baluster portion and second baluster portions may also include a non-tubular portion, such as scroll portion 118 and/or 119, so as to provide architectural interest and variation. The first baluster portion and/or the second baluster portion may also have an additional decorative portion attached thereto, as exemplified by the embodiments shown in FIGS. 27 and 28.

For convenient assembly, it is preferred that the first and second baluster portions 111 and 115 are of different lengths.

Figure 28:
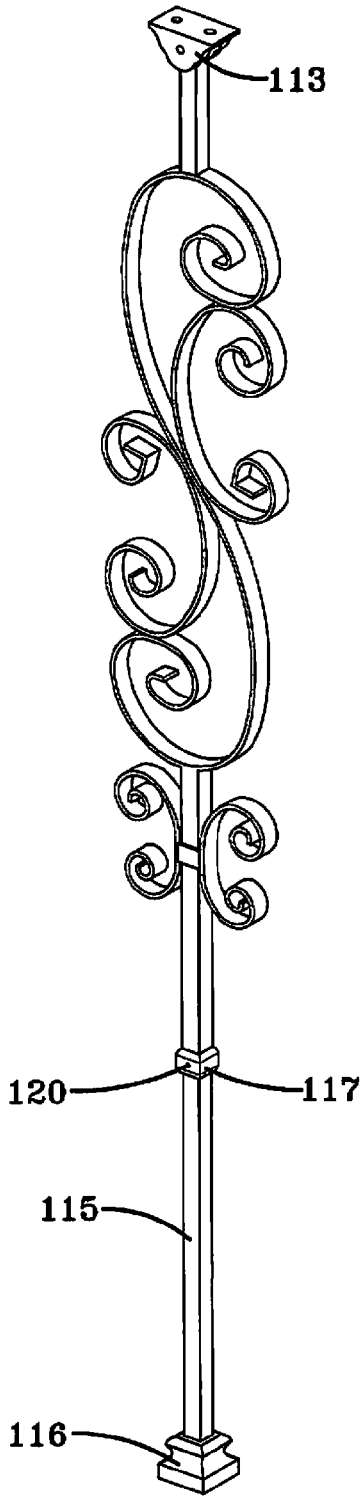
FIG. 28 shows a perspective view of a baluster in accordance with another embodiment of the present invention.
Figure 34:
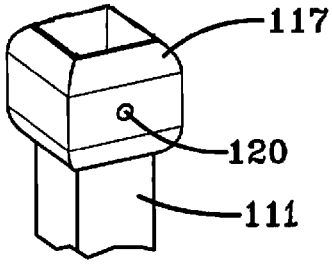
FIG. 34 shows a detailed perspective view of a portion of a baluster portion in accordance with another embodiment of the present invention.

The locking fixture 117 may be adapted to fix the position of the first baluster portion with respect to the second baluster portion. The locking fixture may be in the form of a set screw through aperture 120 as seen in FIG. 28. The locking fixture 117 may alternatively be in the form of a fixture that includes a screw thread to be threaded onto either of the first baluster portion and the second baluster portion, such as by having the exposed end of the first baluster portion 111 provided with a thread such that this portion of the first baluster portion is urged against the second baluster portion as the locking fixture is screwed onto the first baluster portion. The locking fixture 117 may be made integral with the first baluster portion 111 as shown in FIG. 34, or as a separate piece that may be made to slide into place.

First attachment 113 may be in the form of a cleat that mounts to the first baluster portion 111 by a swivel pin that may also slide within channel 121 to allow the cleat to be best positioned to fit against a surface, such as the underside of a stair railing or other structure (not shown). Attachment 113 may also define an aperture 121 that receives a set screw as shown in FIG. 32.

Figure 29:
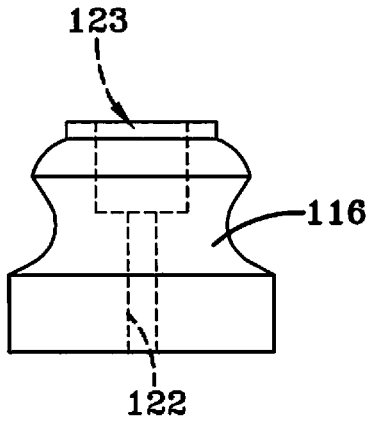
FIGS. 29-31 show detailed views of an attachment portion that may be used with several embodiments of the present invention.
Figure 30:
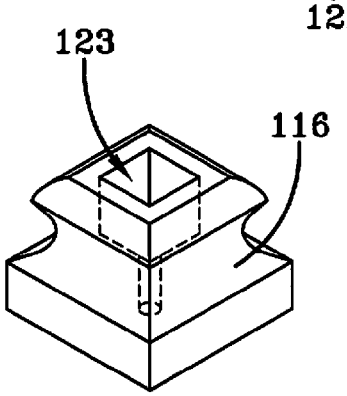
Figure 31:
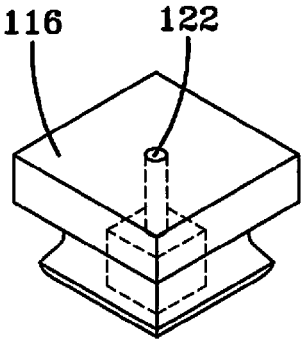

FIGS. 29, 30 and 31 are detailed views of the bottom, second attachment 113, showing the hole 122 through which a screw may extend to affix it to a stair surface, and showing the aperture 123 into which the lower baluster portion extends.

Figure 32:
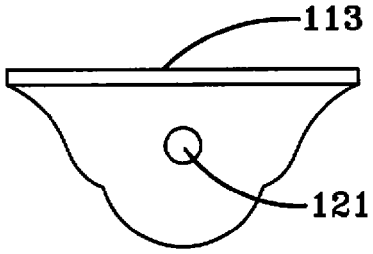
FIGS. 32 and 33 show detailed views of an attachment piece that may be used with several embodiments of the present invention.
Figure 33:
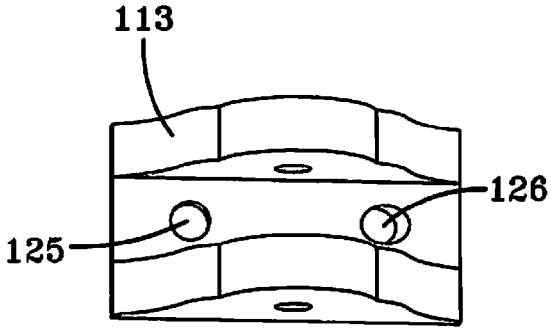

FIGS. 32 and 33 are detailed views of the top, first attachment 113, showing the holes 125 and 126 through which screws may extend to affix it to a railing surface.

FIG. 34 is a detailed view of the first engagement end of the first baluster portion 111 showing locking fixture 117 with aperture 120 for a set screw.

Figure 35:
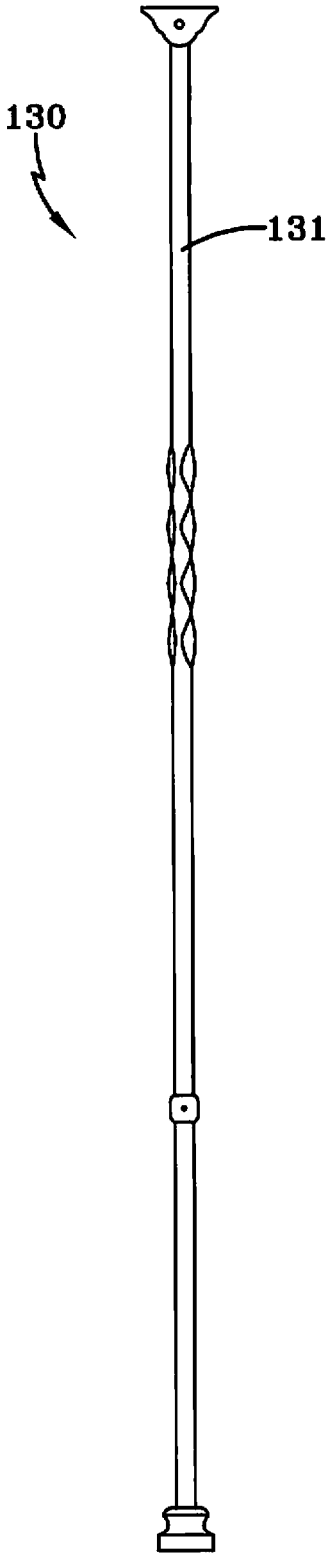
FIGS. 35 and 36 show elevation views of a baluster in accordance with another embodiment of the present invention.
Figure 36:
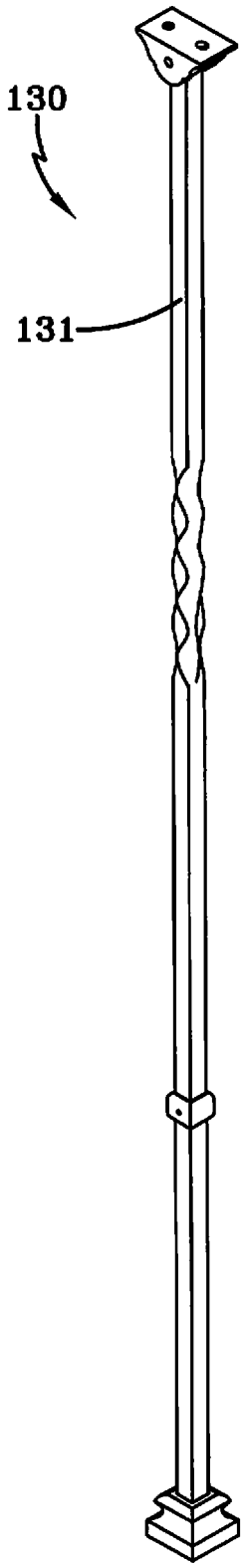

FIGS. 35 and 36 show elevational and perspective views of a baluster 130 in accordance with another embodiment of the present invention. The baluster 130 is identical to that of FIG. 27 with the exception that first baluster portion 111 has been replaced by first baluster portion 131 of a different design.

Although the preferred embodiment of the present invention has been shown and described, it will be apparent to those skilled in the art that many changes and modifications may be made without departing from the invention in its broader aspects.

The appended claims are therefore intended to cover all such changes and modifications as fall within the true spirit and scope of the invention.

What is claimed is:

1. A method of retrofitting a stair railing system having a hand railing disposed above a plurality of steps with a plurality of existing balusters disposed between a lower surface of the hand railing and an upper surface of the steps; the method comprising the steps of:

removing at least one existing baluster without removing the hand railing or any of the steps;

providing an adjustable-length baluster having a lower baluster portion and an upper baluster portion that are slidable with respect to each other to adjust the overall length of the baluster; the upper and lower baluster portions having non-circular cross sections with a portion of the lower baluster portion disposed inside the upper baluster portion; the adjustable-length baluster also having a lower attachment and an upper attachment;

connecting the lower attachment to the upper surface of the step at the general location where the existing baluster was removed;

sliding at least one of the upper and lower baluster portions with respect to the other of the upper and lower baluster portions until the overall length of the adjustable baluster is less than the distance between an upper surface of the lower attachment and the lower surface of the hand railing;

inserting the lower end of the lower baluster portion into the lower attachment;

expanding the adjustable baluster until the upper attachment is disposed against the lower surface of the railing; and connecting the upper attachment to the lower surface of the hand rail.

2. The method of claim 1, further comprising the step of clamping the upper baluster portion to the upper attachment.

3. The method of claim 2, wherein the upper attachment includes a pair of spaced ears and further comprising the step of clamping the top end of the upper baluster to one ear of the upper attachment to clamp the upper baluster portion to the upper attachment.

4. The method of claim 3, further comprising the step of locking the upper baluster portion to the lower baluster portion with a locking fixture.

5. A method of retrofitting a stair railing system having a hand railing disposed above a plurality of steps with a plurality of existing balusters disposed between a lower surface of the railing and an upper surface of the steps; the method comprising the steps of:

removing at least one existing baluster without removing the hand railing or any of the steps;

providing an adjustable-length baluster having a lower baluster portion and an upper baluster portion that are slidable with respect to each other to adjust the overall length of the baluster; the adjustable-length baluster also having a lower attachment and an upper attachment;

connecting the lower attachment to the upper surface of the step at the general location where the existing baluster was removed;

connecting the upper attachment to the upper baluster portion such that the upper attachment may pivot with respect to the upper baluster portion;

sliding one of the upper and lower baluster portions with respect to the other of the upper and lower baluster portions until the overall length of the adjustable baluster is less than the distance between an upper surface of the lower attachment and the lower surface of the hand railing;

inserting the lower end of the lower baluster portion into the lower attachment;

expanding the adjustable baluster until the upper attachment is disposed against the lower surface of the railing;

moving the upper attachment with respect to the lower surface of the railing until the upper and lower baluster portions are vertical;

connecting the upper attachment to the lower surface of the hand rail without removing the upper attachment from the upper baluster portion;

locking the position of the upper attachment with respect to the upper baluster; and locking the position of the upper baluster portion with respect to the lower baluster portion.

6. The method of claim 5, wherein the upper attachment includes a pair of spaced ears and further comprising the step of clamping the top end of the upper baluster to one ear of the upper attachment to clamp the upper baluster portion to the upper attachment.

7. The method of claim 6, further comprising the step of positioning the upper end of the upper baluster portion between the pair of spaced ears.

8. The method of claim 6, wherein the step of clamping includes the steps of providing a threaded connector having a head and engaging the head of the connector with the upper baluster.

9. The method of claim 5, wherein the step of locking the position of the upper baluster with respect to the lower baluster portion includes the steps of providing a set screw carried by the upper baluster portion and tightening the set screw against a portion of the lower baluster portion.

10. The method of claim 5 wherein the step of sliding at least one of the upper and lower baluster portions with respect to the other of the upper and lower baluster portions includes the step of locating a portion of the lower baluster portion within the upper baluster portion.

11. The method of claim 5, further comprising the step of adding a decorative element to the upper baluster portion.

12. The method of claim 5, wherein the step of connecting the lower attachment to the upper surface of the step includes the step of locating a connector directly under the lower baluster portion to hide the connector from view.

* * * * *